US007373971B2

(12) United States Patent
Montgomery

(10) Patent No.: US 7,373,971 B2
(45) Date of Patent: May 20, 2008

(54) PUMP JACK AND METHOD OF USE

(75) Inventor: Neil Montgomery, Red Deer (CA)

(73) Assignee: Crostek Management Corp., Red Deer, Alberta (CA)

( * ) Notice: Subject to any disclaimer, the term of this patent is extended or adjusted under 35 U.S.C. 154(b) by 205 days.

(21) Appl. No.: 11/208,646

(22) Filed: Aug. 23, 2005

(65) Prior Publication Data

US 2006/0045769 A1 Mar. 2, 2006

Related U.S. Application Data

(60) Provisional application No. 60/603,563, filed on Aug. 24, 2004.

(51) Int. Cl.
*E21B 43/00* (2006.01)

(52) U.S. Cl. ..... 166/66.5; 166/369; 166/68.5; 166/66.4; 166/72

(58) Field of Classification Search ..... 166/369, 166/68.5, 66.4, 66.5, 379
See application file for complete search history.

(56) References Cited

U.S. PATENT DOCUMENTS

| | | | | |
|---|---|---|---|---|
| 3,405,605 | A * | 10/1968 | Ross | 91/173 |
| 4,102,394 | A * | 7/1978 | Botts | 166/66 |
| 4,114,375 | A | 9/1978 | Saruwatari | |
| 4,201,115 | A | 5/1980 | Ogles | |
| 4,438,628 | A * | 3/1984 | Creamer | 60/374 |
| 4,463,828 | A | 8/1984 | Anderson | |
| 4,501,119 | A * | 2/1985 | Stanton | 60/398 |
| 4,687,054 | A * | 8/1987 | Russell et al. | 166/66.4 |
| 4,768,595 | A * | 9/1988 | Smith | 166/369 |
| 5,196,770 | A | 3/1993 | Champs et al. | |
| 5,960,875 | A | 10/1999 | Beauquin et al. | |
| 2002/0134546 | A1* | 9/2002 | Zupanick | 166/52 |

FOREIGN PATENT DOCUMENTS

| | | |
|---|---|---|
| CA | 2250739 | 10/1997 |
| CA | 2222459 | * 11/1997 |

* cited by examiner

*Primary Examiner*—David J. Bagnell
*Assistant Examiner*—Sean D Andrish
(74) *Attorney, Agent, or Firm*—Paul S. Sharpe; Ogilvy Renault LLP

(57) ABSTRACT

An electromagnetic ram for use in artificially lifting fluid from a well and in particular an oil well. The disclosure also teaches a method and system employing the ram. The use obviates existing systems used today in terms of cost, environmental concerns, optimized mechanical efficiencies and maximizing overall production of wells on a case by case basis.

11 Claims, 1 Drawing Sheet

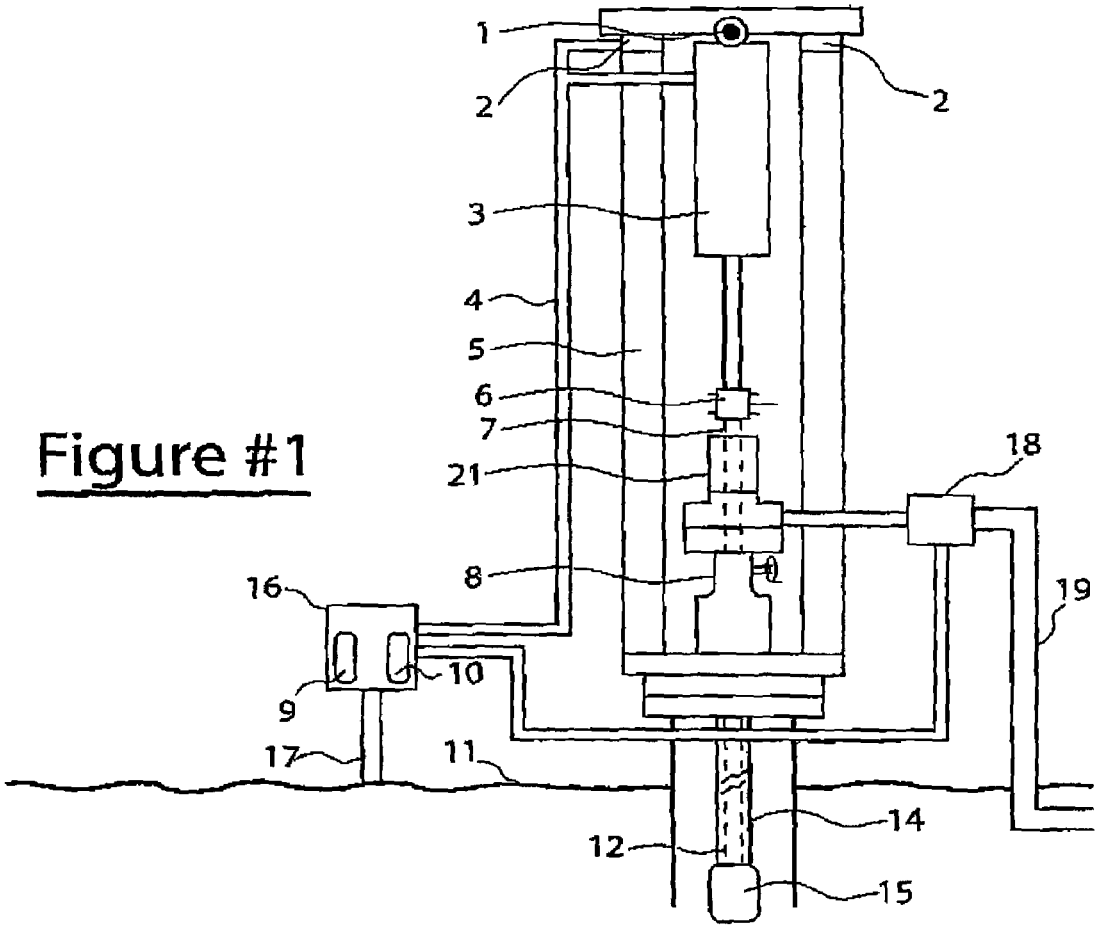
Figure #1

PUMP JACK AND METHOD OF USE

CROSS-REFERENCE TO RELATED APPLICATIONS

This application claims benefit from U.S. Provisional Application No. 60/603,563, filed Aug. 24, 2004.

FIELD OF THE INVENTION

The present invention relates to an efficiency pumping jack system, particularly, the present invention relates to a well vertical pump jack system for efficiency pumping incorporating an electromagnetic ram.

BACKGROUND OF THE INVENTION

As is known in the art, various styles of pump jacks have been used in combination with oil wells for many years and as one possibility employ fluid power operated piston and cylinder assemblies for operating the pump jack. The fluid assemblies assist in operating the reciprocating down hole pump, sucker rod and polish rods. Perhaps the most common and oldest pump-jack system known today incorporates a walking beam type which utilizes counterweights, a gear box and a prime-mover such as a rotary electric motor or an internal combustion motor which will run on various fuel sources. These units are typically costly to purchase, large and heavy to transport, time consuming to set up, mechanically inefficient and draw a significant amount of power. They also have a heavy foot-print which is unacceptable in environmentally sensitive areas.

As is well recognized in the art, the hydraulic pump jack systems are conventionally used on low to medium production wells and unfortunately have low efficiency (approximately 30 percent) and require extensive power. A further limitation is realized in the environmental unfriendliness of such arrangements, namely, oil leaks and misting inter alia.

Another example of a surface pumping system is referred to as a progressive cavity type pump. Such pumps are employed for use in medium to high volume wells and are particularly useful on wells with heavy sand concentrations or those which are used to produce heavy oil. It has been realized that progressive cavity pumps are not as useful in wells with high hydrogen sulfide concentration or wells containing high concentrations of carbon dioxide. Accordingly, these pumping systems are limited in durability. Another form of a pump jack is a Roto-Flex system. These arrangements have good power efficiency of between 40 and 50 percent and are used in medium to high volume wells and provide for a long stroke capability. Although useful, the Roto-Flex units are not particularly environmentally friendly.

Yet another variation on the pumping arrangements used in fluid extraction includes the electric submersible type pumping units which are particularly useful for large volume wells with no gas. These arrangements are useful in some situations, but are quite limited in environments where wells contain gas in fluid. They also suffer from significant power consumption and poor performance in heavy oil.

In terms of hydraulic/pneumatic pump jack systems which are generally surface based, these have the advantage of being relatively inexpensive to setup and can be customized by the user. Such arrangements are only useful for low to medium volume wells and produce medium efficiency. However, although there are advantages to such arrangements these types of pump jacks perform poorly in very hot weather, very cold weather and are environmentally unfriendly.

A further variation on a pumping system is the conventional "gas lift" system used for removing fluid from a well. These devices require no power and are relatively inexpensive to install and are useful in low volume marginal wells using well gas as the prime mover.

One arrangement known in the art is shown in U.S. Pat. No. 4,201,115, issued May 6, 1980 to Ogles. The system is an oil well pump jack with dual hydraulic operating cylinders. The arrangement incorporates the cylinders for pivoting the walking beam of the jack and includes a unique control arrangement for controlling operating of the piston and cylinders. The control system also permits operation of the hydraulic piston and cylinder assemblies in a double action mode or a single action mode.

Saruwatari, in U.S. Pat. No. 4,114,375, issued Sep. 19, 1978, discloses a pump jack device having a double acting piston and cylinder motor with the piston rod of the motor adapted for connection to the polished rod projecting upwardly from the well head.

In U.S. Pat. No. 4,463,828, issued to Anderson, Aug. 7, 1984, a pump jack is disclosed having a spring handle for cranking the pump jack down and provides a safety lock against accidental unwinding of a helical rod holding the jack on the pole.

Although the devices previously proposed in the art have merit, it is clear that many of the systems employ hydraulically operated cylinders or gear boxes and motors for actuating the reciprocating pump and other critical components in the well. It would be more desirable to have a high efficiency arrangement which did not suffer from the limitations inherent in these systems. The present invention is directed to alleviating the previous limitations in the art.

The present invention discussed in greater detail hereinafter virtually eliminates all the problems with prior art conventional crank and hydraulic surface drive and various other pumping systems. This invention results in a surface drive mechanism that is efficient, both in energy used and oil pumped and also limits the stresses on all the surface and downhole mechanical components. The unit requires very little site preparation, is light weight, easy to move, and simple to install. Conveniently, operation is fully computerized and will act as a "smart" pump jack aiding in the optimization of each specific given well.

SUMMARY OF THE INVENTION

One object of the present invention is to provide an improved oil well pump jack having high efficiency.

Advantageously, having a system which limits the energy used will reduce and limit peak energy substantially resulting in lower energy costs for the end user. This is particularly important considering the practice of the electricity suppliers to bill the entire year based on the peak energy used, even if the peak is only for a few hours.

A further object of one embodiment of the present invention is to provide use of an electromagnetic ram for pumping oil from an oil well with a linear pump jack apparatus.

Significant advantages have been realized via making use of the electromagnetic ram. One of the most advantageous features is the fact that the system is electronic and therefore does not have the limitation of friction loss, atomized leak, cooling, or other significant problems inherent in hydraulic systems. Additionally, the electromagnetic ram arrangement provides for excellent power efficiency in motion and simply does not use any electrical power when the system is static. As a further advantage, the ram can and will act on the down stroke as a power generator returning power to the supply system. This is not possible with hydraulic or any other pump jack systems and represents a distinct advantage over existing prior art pump jacks.

A further object of one embodiment of the present invention is to provide a pump jack suitable for use on an oil well for pumping fluid from an oil well, comprising: a well head; a support structure connected to the well head; an electromagnetic ram connected to the support structure; a polish rod connected to the electromagnetic ram; pump means connected to the polish rod and rod string for pumping the fluid from the well; and conduit means for transporting recovered fluid pumped from the well.

By incorporating the electromagnetic ram, the system has been able to achieve greater than 90% efficiency with very desirable properties including a smooth precise response, no mechanical backlash and zero hysteresis. The arrangement has only one moving part and provides dual action.

A still further object of one embodiment of the present invention is to provide a method of pumping from a well containing fluid, comprising: providing a pump jack apparatus having a well head positioned over a well, a reciprocating pump disposed within the well and a support structure for supporting the pump and the well head; providing an electromagnetic ram connected to the pump; actuating the electromagnetic ram; and pumping fluid from within the well.

Any electromagnetic ram may be incorporated in the system, an example of which is that which is depicted in U.S. Pat. No. 5,440,183, issued Aug. 8, 1995, to Denne.

This device provides utility in the combination set forth herein and assists in providing a very efficient oil pump jack.

Particularly convenient is the fact that the arrangement can be employed in any type of fluid well, such as a water well, coal bed methane well, oil well, etc.

Having thus generally described the invention, reference will now be made to the accompanying drawing.

BRIEF DESCRIPTION OF THE DRAWINGS

FIG. 1 is a schematic illustration of the overall system according to one embodiment of the present invention.

DETAILED DESCRIPTION OF THE PREFERRED EMBODIMENT

FIG. 1 schematically illustrates one embodiment of the linear electro-magnetic ram artificial lift pump jack system, as well as the downhole components. The conventional wellhead 8 shows the polish rod 7 which passes through a wellhead stuffing box 21, and connects to a sucker rod 12. The sucker rod 12 passes down the inside of tubing string 14 to the reciprocating pump 15. The linear electro-magnetic ram 3 connects to the polish rod 7 by the polish rod clamp 6. The linear electro-magnetic ram 3 is connected to the support structure 5 by a structure link 1. The top portion of the structure sits on two weight sensors 2 which measure the weight of the moving pump assembly against the fixed support structure 5.

The electrical/pneumatic piping 4 connects the linear electro-magnetic ram 3, and weight sensors 2 to the controller unit housing 16. The controller unit housing 16 consists of a sealed weather tight cabinet with controller electronics 9 and the pneumatic controller system 10 inside. The controller unit housing 16 is mounted on a steel mounting post 17, fixed to the ground 11.

The linear electro-magnetic ram 3 works like a rotary stepping motor but instead of rotating, the ram moves in a jacking motion and extends and retracts linearly. The controller 9 and 10 can step the motor a fraction of an inch for each step. With this fractional movement and by varying the stepping rate, the motor can move to precise positions at various speeds. Adjusting the power applied for each step, the force of the movement can be controlled in minute steps. By controlling the stepping rate and the power applied, a smooth movement can be applied to the downhole reciprocating pump with controlled acceleration and deceleration to keep stresses on the sucker rod string 12 to a minimum.

The weight sensors 2 are monitored by the control electronics 9 during the movement of the linear electro-magnetic ram 3. If the stress on the pump increases close to the programmed limits, the control electronics 9 will reduce the power applied to the linear electro-magnetic ram 3 protecting all components on/in the well and attached pipeline infrastructure. If a fault causes excessive mechanical stresses, the control electronics 9 will stop the linear electro-magnetic ram 3 to wait for an operator to assess the problem. The flow from the well is monitored by a flow meter 18. This meter can be any conventional meter such as a turbine or paddle wheel meter which outputs a signal proportional to the flow through the pipeline 19.

The controller software (not shown) can be programmed to optimize flow by varying downhole reciprocating pump stroke speed and length. The control software can vary stroke speed/length. Limits can easily be placed on all pump jack parameters as required. For poor producing wells, the control software will see the flow dropping off after a time and reduce either/or the downhole pump speed or length of stroke. The software can also be programmed to give a poor flowing well or "gas locked" reciprocating down hole pump more recovery time by stopping the stroke for a period of time until the formation recovers or until the pump hydrostatically fills with fluid and expels the gas lock.

In summary, a number of convenient features result from the arrangement, namely:

a) flow optimization by monitoring fluid flow through a flow meter and controlling the downhole reciprocating pump stroke parameters;
b) protect the sucker rod and downhole pump from excessive mechanical forces by monitoring the weight of the pump assembly;
c) detection of common pumping problems;
d) shutdown if a fault is detected in the downhole pump assembly such as an increase in pump assembly weight;
e) shutdown if a fault is detected in a reduction in pump assembly weight;
f) monitor electrical energy use and slow the motor speed if the motor is reaching the maximum configured energy limit; and
g) control the acceleration and deceleration of the downhole pump assembly to keep stress to a minimum;
h) Controller could be programmed to provide a dynamometer card to enhance well optimization.
i) Up to the minute production will be flow tested to ensure downhole reciprocating pump remains free of any cavitation and eliminate what is known in the art as "fluid pounding" or "fluid hammer".

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. An apparatus for pumping liquid from a well, comprising in combination:

a well head, a rod string and pump;

an electrically operated electromagnetic ram operable in the absence of hydraulic fluid;

said ram being positioned vertically above said well head and connected to said pump within said well by said rod string, the weight of the rod string, the pump and a liquid column being supported by said electromagnetic ram, said ram being operable in response to current delivered thereto.

2. The apparatus as set forth in claim 1, in which the force produced by said ram is determined by both gas pressure and electric current acting simultaneously.

3. The apparatus as set forth in claim 2, including control means for determining the motion of said ram.

4. The apparatus for pumping a liquid from a well as set forth in claim 1, further including means to determine the force acting on the ram.

5. The apparatus as set forth in claim 1, wherein said ram is connected directly to said rod string.

6. The apparatus as set forth in claim 2, wherein said electromagnetic ram has a single moving part.

7. The apparatus as set forth in claim 6, wherein said single moving part comprises a piston.

8. The apparatus as set forth in claim 2, wherein said electromagnetic rain is a linear electromagnetic ram.

9. In an apparatus for pumping liquid from a well having a well head, a pump and a rod string, the improvement comprising:

an electrically operated electromagnetic ram positioned above the well head connected to said pump within said well by the rod string, said ram being operable solely by the delivery of electrical current in the absence of hydraulic fluid.

10. A method for pumping liquid from a well having a well head, a pump and a rod string, comprising the steps of:

providing an electrically operated electromagnetic ram operable in the absence of hydraulic fluid;

positioning said ram vertically above said well head and connected to said pump within said well by said rod string, the weight of said rod string, said pump and a liquid column being supported by said ram;

activating said ram solely by the delivery of electrical current to said ram; and pumping a liquid from said well.

11. The method as set forth in claim 10, further including the step of providing control means for controlling said ram.

* * * * *